US005499900A

United States Patent [19]

Khmara et al.

[11] Patent Number: 5,499,900

[45] Date of Patent: Mar. 19, 1996

[54] VORTEX FLOW BLOWER

[75] Inventors: Vladimir N. Khmara; Ljudmila N. Belotelova, both of Moscow; Vladimir N. Sergeev, Moskovskaya, all of Russian Federation

[73] Assignee: Joint Stock Company En & Fi, Moscow, U.S.S.R.

[21] Appl. No.: 296,819

[22] Filed: Aug. 26, 1994

[30] Foreign Application Priority Data

Dec. 29, 1992 [RU] Russian Federation ..... 92-015131/06

[51] Int. Cl.[6] ..... F04D 5/00; F04D 29/40

[52] U.S. Cl. ..... 415/55.1; 415/55.4

[58] Field of Search ..... 415/55.1, 55.2, 415/55.4, 119

[56] References Cited

U.S. PATENT DOCUMENTS

| | | | |
|---|---|---|---|
| 3,355,095 | 11/1967 | Hollenberg | 415/55.1 |
| 3,356,033 | 12/1967 | Ullery | 415/55.4 |
| 3,360,193 | 12/1967 | Harris et al. | 415/55.1 |
| 5,143,511 | 9/1992 | Verneau et al. | 415/55.1 |
| 5,281,083 | 1/1994 | Ito et al. | 415/55.1 |

FOREIGN PATENT DOCUMENTS

| | | | |
|---|---|---|---|
| 61-175297 | 8/1986 | Japan | 415/55.1 |
| 387145 | 10/1973 | U.S.S.R. | 415/55.4 |
| 436175 | 12/1974 | U.S.S.R. | 415/55.4 |

*Primary Examiner*—Edward K. Look
*Assistant Examiner*—Michael S. Lee
*Attorney, Agent, or Firm*—Michael N. Meller

[57] ABSTRACT

A vortex compressor for compressing a fluid and having an annular working channel into which the fluid is introduced and compressed before being discharged through an outlet of the channel. A two-piece stripper seal is arranged in the channel and has a first radially inward member and a second radially outward member, the stripper seal members and the inlet and outlet being respectively circumferentially offset from each other. The outward member being closer to the outlet and the inward member being closer to the inlet. The stripper seal has an orifice for fluid removal so that fluid introduced into the inlet of the channel is compressed and emitted from the outlet and the orifice.

5 Claims, 3 Drawing Sheets

VORTEX FLOW BLOWER

This is a continuation of PCT/RU93/00315 filed Dec. 27, 1993.

BACKGROUND OF THE INVENTION

1. Field of the Invention

The present invention relates to a field of machines and more particularly to compressors of a vortex type.

2. Description of the Prior Art

A vortex compressor is known comprising a casing with an annular working channel having suction and discharge ports and a stripper seal is arranged in the channel between the ports. An impeller is mounted in the casing, a disc of the impeller having blades thereon to form a blade set and the stripper seal has an orifice for gas removal (see DE-A-2409184).

In this known design, gas, contained in the space between the blades is heated as it is compressed and is partially released from the stripper seal through the orifice. This reduces the undesirable transfer of hot gas from the compressor suction side to the discharge side and increases the machine efficiency. The gas is removed from the stripper seal back to the annular working channel through the orifice along a special pipeline to a zone of an intermediate pressure. Although this design reduces the harmful impact of ballast gas, it is not sufficient since hot gas under some intermediate pressure appears at the compressor suction side from the space between the blades.

Another vortex compressor is known comprising a casing in which are formed an annular working channel, suction and discharge ports communicating with the annular channel, a stripper seal arranged between the suction and discharge ports, an impeller mounted in the casing, a ring of blades, mounted on a disc of the impeller, is located in the annular working channel, and wherein the casing and stripper seal comprise regions having arched shapes, communicating therebetween and equidistant from the blade edges (see SU-A-328265).

In this latter design, ballast hot gas from the space between the blades is almost completely removed to the ambient air and excluded from the compression process in the compressor. This design provides a blowing effect which, owing to a specific arched shape and arrangement of the region, the hot gas in the space between the blades is replaced by cold gas entering from the atmosphere. Such blowing effect ensures an increase of the machine efficiency, reduction of the gas temperature at the suction side due to lack of replenishment by the ballast hot gas, raising the amount of compression at this stage and improvement of weight output.

In such design, the amount of blowing depends substantially on the size of the arched region. On the one hand, the reduction of an arched region results in incomplete blowing with all resulting consequences. On the other hand, although the increase of the arched region intensifies the blowing, it can be attained only by increasing a portion of the annular channel occupied by the stripper seal since the arc is arranged within the margins of this portion. This results in reduction of the remaining portion of the working channel wherein the compression takes place thereby reducing the efficiency of the compressor. Therefore, the efficiency of this design is limited by the blowing.

3. Summary of the Invention

It is an object of present invention to provide a vortex compressor combining two gas dynamic blowing processes, namely, a removal of hot gas from a stripper seal, and a suction, and thereby to intensify the flow at the vortex compressor input and to extend a zone of an efficient compression process in an annular working channel, and thus, to raise the efficiency of the vortex compressor.

The object is attained by providing a vortex compressor for compressing a fluid and comprising a casing having an annular working channel adapted to have fluid compressed therein. A blade set having a plurality of blades rotatably mounted in the casing is provided and adapted to compress fluid in the channel. The compressor includes an inlet for the channel disposed radially inward of the blade set, an outlet for the channel disposed radially outward of the blade set, a two-piece stripper seal arranged in the channel and having a first radially inward member and a second radially outward member, in which the first and second members of the stripper seal are circumferentially offset from each other. The inlet and outlet of the compressor being circumferentially offset from each other, the radially outward member of the stripper seal being circumferentially closer to the outlet than the radially inward member of the stripper seal and the radially inward member of the stripper seal being circumferentially closer to the inlet than the radially outward member of the stripper seal. The stripper seal has an orifice for fluid removal, whereby fluid introduced into the inlet of the channel is compressed and emitted from the outlet of the channel and the orifice of the stripper seal.

Alternatively, a vortex compressor can be provided wherein the members of the stripper seal are two concentric annular members, the radially outward member being shorter than the radially inward member circumferentially along the annular channel.

Alternatively, a vortex compressor can be provided wherein the inlet of the channel is disposed adjacent an edge of the radially inward member of the stripper seal and the radially outward member of the stripper seal is circumferentially offset towards the other edge of the radially inward member.

Further a vortex compressor can be provided wherein the orifice of the stripper seal has a length in the circumferential direction of the channel longer than the combined length of the inlet and the radially inward member of the stripper seal and at least a portion of the inlet of the channel lies along a common radius with the orifice of the stripper seal.

Alternatively, a vortex compressor can be provided with a baffle arranged in the working annular channel at an end of the orifice of the stripper seal for removing compressed fluid more efficiently.

The disclosed advantages of the present invention will become more apparent from further description of the preferred embodiment of the invention with references to the accompanying drawings.

DESCRIPTION OF THE PREFERRED EMBODIMENT OF THE INVENTION

Figure 1:
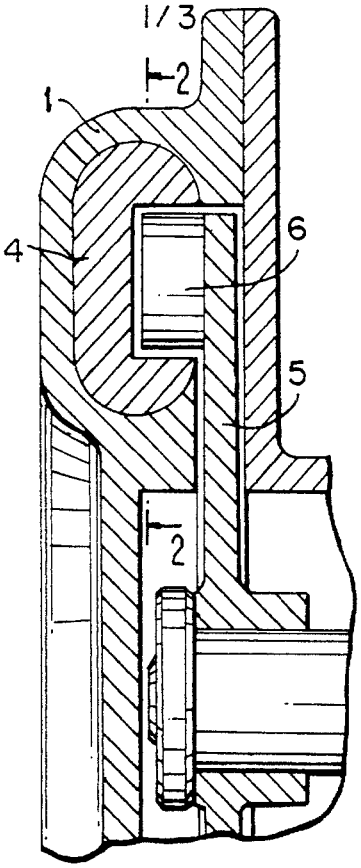
FIG. 1 is a schematic sectional side view of a portion of the vortex compressor.
Figure 2:
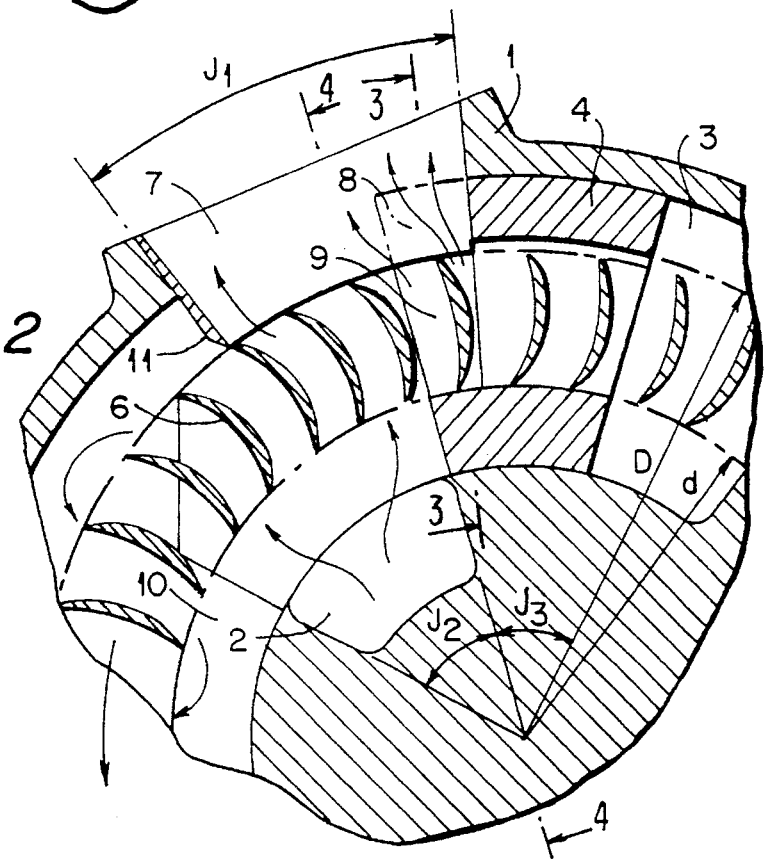
FIG. 2 is a sectional view taken along the line A—A of FIG. 1.

Referring to the drawings and more particularly to FIGS. 1 and 2, a vortex compressor is shown having a casing 1 with an annular working channel. The annular working channel of the casing 1 comprises a suction port or inlet 2 and a discharge port or outlet 3 through which gas enters the turbocompressor and leaves it, respectively. Gas can enter, for example, from the environment, and exit, for example, to a pipe-line leading to the user of the compressed air. A stripper seal 4 is arranged between the inlet 2 and the outlet 3. The stripper seal 4 has a radially inward member 4A and a radially outward member 4B. An impeller is mounted in the casing 1 and on its disc 5 there is provided a blade set of blades 6, arranged in the annular working channel. In the casing 1 and stripper seal 4 there are provided orifices 7 and 8, accordingly, for blowing fluid through the stripper seal 4. An orifice 7 in the casing 1 and orifice 8 in the stripper seal 4 communicate therebetween, have an arched shape and are equidistant from the outer diameter of the blade set 6.

According to the illustrated embodiment of the present invention, the radially inward and radially outward edges of the blade set 6 are arranged along a radius of the disc 5. Accordingly, the radially inward edges of the blade set 6 are arranged along the circumference of a circle having a diameter "d" (see FIG. 2). The radially outward edges of the blade set 6 are arranged along the circumference of a circle having a diameter "D". The inlet 2 is formed as an opening having an arched shape, equidistant to the radially inward edges of the blade set 6 and arranged at the side of the radially inward edges of the blades, i.e. at the inner side with regard to the circle of a diameter "d". The orifice 7 in the casing 1 and the orifice 8 in the stripper seal 4 are located at the side of the radially outward edges of the blade set 6, i.e. at the outer side with regard to the circle of a diameter "D". The orifice 7 in the casing 1, the inlet 2 and the stripper seal 4 are arranged in three sectors J1, J2, J3, respectively (see FIG. 2), at a plane perpendicular to a pivot axis of the disc 5. The sector J2 of the inlet 2 is adjacent to the sector J3 of the stripper seal 4. A portion of the sector J3 of the stripper seal 4 is combined with the sector J1 of the orifice 7 in the casing 1, and the orifice 8 in the stripper seal 4 is located in a portion of the sector J1 of the orifice 7 in the casing 1 combined with the sector J3 of the stripper seal 4.

In other words, the sector J1 overlaps a common portion of the two adjacent sectors J2 and J3.

Figure 3:
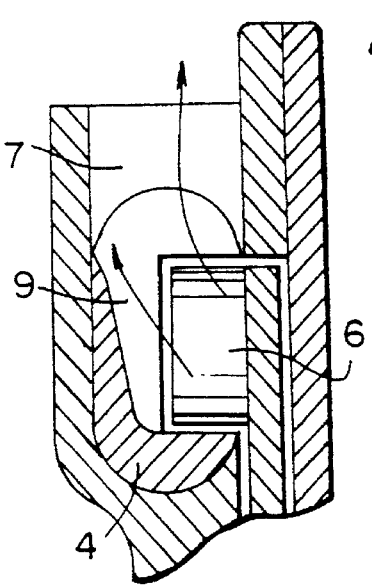
FIG. 3 is a sectional view taken along the line B—B of FIG. 2.

In the wall of the stripper seal 4 (see FIG. 3), at the side of the blade set 6, there can be provided a recess 9 open to the recess 8 in the stripper seal 4. (In FIG. 2, a profile of the stripper seal 4, occupied by the orifice 8 of the stripper seal 4 and recess 9 of the stripper seal 4, is indicated by a dot-and-dash line).

Figure 4:
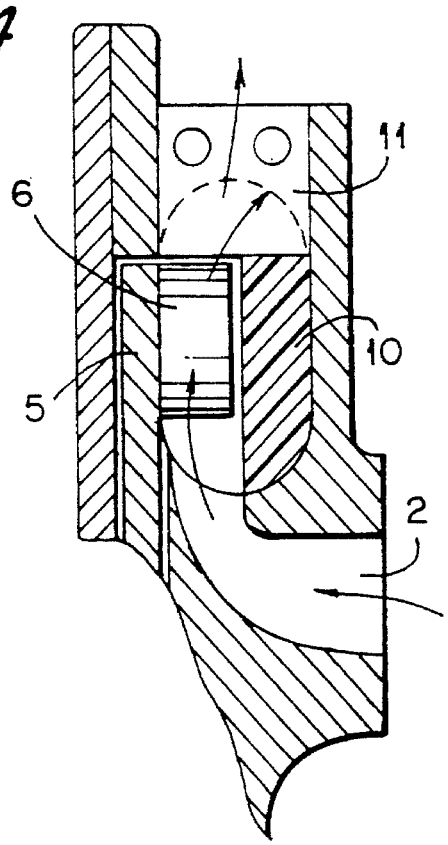
FIG. 4 is a sectional view taken along the line C—C of FIG. 2.

A vortex compressor, as shown in FIG. 4, can be provided with an insert 10 of a sound-absorbing material, secured to a wall of the annular working channel opposite to the inlet 2 and blade set 6.

As illustrated in FIG. 2 the vortex compressor can be provided with a baffle 11 arranged radially in the annular working channel at the end of the orifice 7 in the casing 1 for removing gas through orifice 7.

Figure 5:
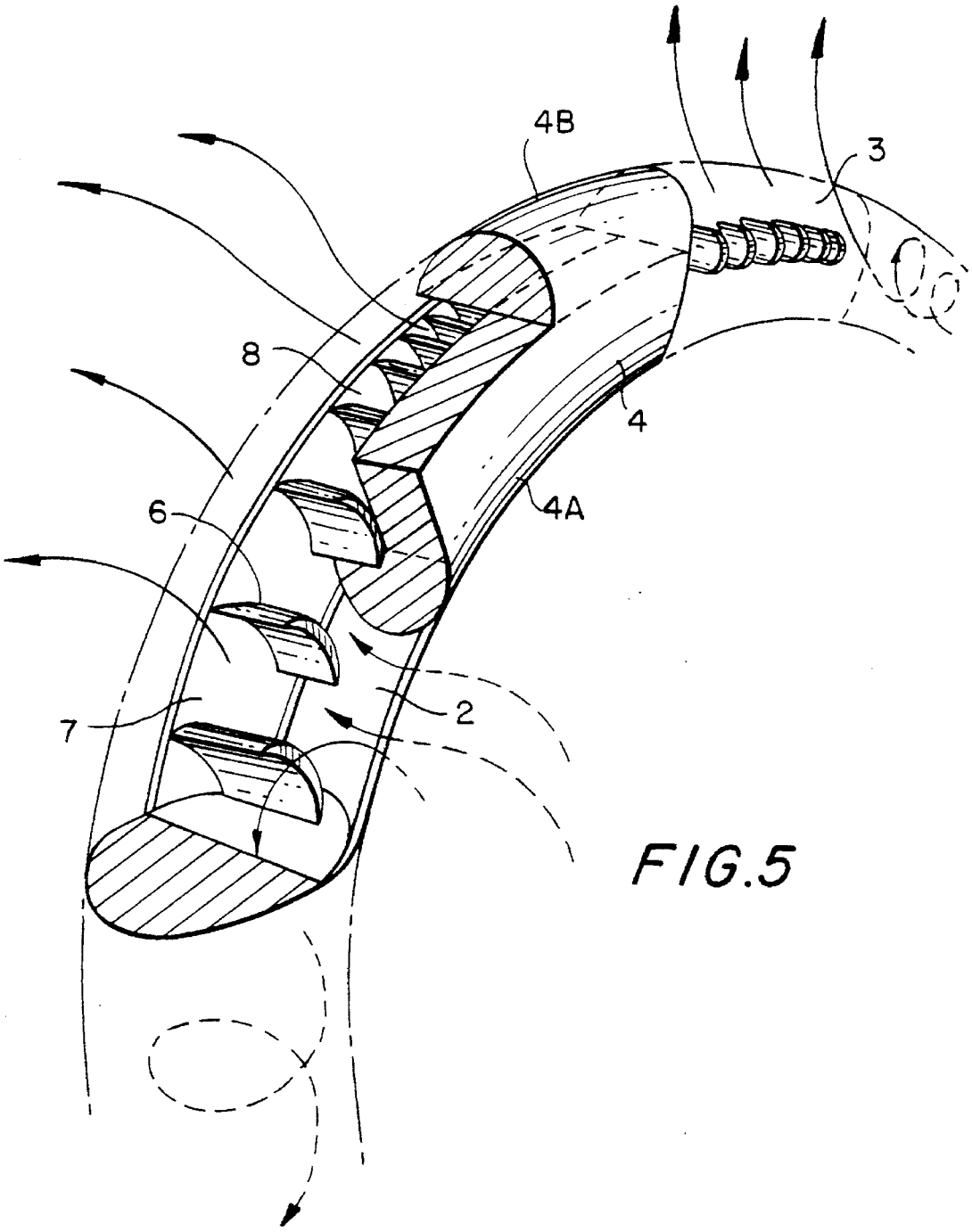
FIG. 5 is a three-dimensional view of a portion of the annular working channel of the preferred embodiment of the present invention.

FIGS. 5 is a three dimensional view of a portion of the annular working channel of the preferred embodiment of the present invention. It can be seen that the radially inward member 4A of the stripper seal 4 is circumferentially offset from the radially outward member 4B. Also the member 4B is circumferentially closer to the outlet 3 than is member 4A. The member 4A is circumferentially closer to the inlet 2 than is member 4B.

In operation of the vortex compressor (FIGS. 1 and 2), when the disc 5 of the impeller rotates, fluid enters the annular working channel of the casing 1 through the inlet 2. In the annular working channel, the blade set 6 transmits energy to the fluid in the process of a helical vortex motion of flow. The compressed fluid is removed from the annular working channel through the outlet 3. A portion of the fluid in the space between the blades 6, compressed to the discharge pressure, is transferred by the blades to the stripper seal 4. In the stripper seal 4, the hot fluid, after entering the portion of the sector J3 adjacent to the sector J2 and open through the orifice 8 in the stripper seal 4 into the orifice 7 in the casing 1, is transmitted from the space between the blades 6 due to a pressure difference and centrifugal forces through orifice 7 in the casing 1 outside, and is thrown out to the atmosphere from the interblade space. In the sector J2 portion, adjacent to the sector J3 and open to the orifice 7, there takes place a blowing of the space between the blades 6; the blades at their radially inward edges get fresh cold fluid from the inlet 2 and eject it through the orifice 7. It should be emphasized that simultaneously there is formed an intense fluid flow through the blade set 6 from its center to its periphery. This process is important from the point of providing further helical vortex motion of flow in the annular working channel. As a result, the suction process, occurring in the portion of the sector J2, not occupied by the orifice 7, is provided by the already formed flow, namely, from the center to the periphery of the blade set 6. Such suction ensures appearance of the vortex motion in the annular working channel just after the inlet 2 and the fluid flow acquires a spinning motion. This raises the compression efficiency of the compressor since the vortex motion is a basic one for transferring energy from the impeller to fluid.

The disclosed effect is inherent only to the present design. For instance, according to SU-A-328265, a flow is formed at a suction side from zero level since the orifice for blowing is separated from the suction side by the stripper seal area. Practice shows that forming of a vortex flow occupies an extensive part of the annular working channel along with the inlet. That is why, saving the annular working channel for efficient gas compression results in an essential improvement. It should be noted that the advantage of the present invention as compared with the design of SU-A-328265 resides also in that the blowing process is divided into two phases, namely, emitting the hot fluid to a portion of the sector J3, open to the orifice 7, and blowing the same at a portion of the sector J2, open to the orifice 7. In so doing, emitting the hot fluid, directed opposite to the blowing flow and hampering its forming is avoided. Ultimately, reduction of the angular dimensions of the sectors J1 and J2, required for a complete blowing and suction is made possible, i.e. to save the annular working channel and to improve efficiency of the compressor.

The recess 9 increases the size of the orifice 8 providing more rapid emission of the hot fluid from the interblade space of the blade set 6 through the orifice 7. It also ensures a reduction of the angular dimensions of the sectors J1 and J2.

The blowing process is accompanied by considerable noise. To reduce the noise and to direct the blowing flow to the interblade space of the blade set 6, there can be provided an insert 10 made of a sound-absorbing material (see FIG. 4).

Shutting off the blowing flow from the suction flow by the baffle 11 ensures a more quickly forming vortex in the annular working channel.

INDUSTRIAL APPLICABILITY

The present vortex compressor can be most successfully used in helical centrifugal turbocompressors and other pumps of non-volumetric replacement for fluids with spinning motion, for instance, in blowers which require at the output thereof a fluid with low temperature, in particular, for flour-milling.

We claim:

1. A vortex compressor comprising:

(I) a casing having an annular, circumferential working channel;

(II) a rotor, (A) said rotor having a plurality of blades, and (B) said rotor rotatably mounted in said casing;

(III) an inlet, (A) said inlet having an upstream edge and and a downstream edge, (1) said upstream edge of said inlet defining a radial line;

(IV) an outlet;

(V) an orifice defining a second outlet;

(VI) a stripper seal;

(A) said stripper seal being disposed in said working channel, (B) said stripper seal having an upstream edge and a downstream edge, (1) said downstream edge defining a radial line, (C) said stripper seal having a first radially inward member, (D) said stripper seal having a second radially outward member, (E) wherein said first and second members are circumferentially offset from one another;

(VII) wherein said radial line that is defined by said upstream edge of said inlet is the same as the radial line that is defined by said downstream edge of said stripper seal;

(VIII) wherein at least a portion of said inlet lies on a common radial line with said orifice.

2. The vortex compressor as claimed in claim 1 wherein said members of said stripper seal are two concentric annular members, said radially outward member being shorter than said radially inward member circumferentially along said annular channel.

3. A vortex compressor as claimed in claim 2 wherein said inlet of said channel is disposed adjacent an edge of said radially inward member of said stripper seal and said radially outward member is circumferentially offset towards the other edge of said radially inward member.

4. A vortex compressor as claimed in claim 3 wherein said orifice of said stripper seal has a length in the circumferential direction of said channel longer than the combined length of said inlet and said radially inward member of said stripper seal.

5. A vortex compressor as claimed in claim 1 wherein a baffle is provided in said working channel adjacent an end of said orifice for increasing the rate of removal of said compressed fluid through said stripper seal.

* * * * *